United States Patent [19]

Murphy

[11] 4,013,561

[45] Mar. 22, 1977

[54] SEPARATORS

[76] Inventor: Herman H. Murphy, Box 61945, Sunnyvale, Calif. 94088

[22] Filed: Sept. 17, 1974

[21] Appl. No.: 506,716

Related U.S. Application Data

[63] Continuation-in-part of Ser. No. 249,919, May 3, 1972, abandoned.

[52] U.S. Cl. ..... 210/222; 210/242 S; 210/DIG. 25

[51] Int. Cl.[2] ..... E02B 15/04

[58] Field of Search ..... 210/23, 36, 40, 30, 210/242, 222, 223, DIG. 21, 386, 396, 400, 402, 152

[56] References Cited

UNITED STATES PATENTS

| | | | |
|---|---|---|---|
| 3,358,838 | 12/1967 | Kosar et al. | 210/242 |
| 3,426,902 | 2/1969 | Kilpert et al. | 210/402 |
| 3,617,552 | 11/1971 | Will et al. | 210/40 |
| 3,617,555 | 11/1971 | Ginsburgh | 210/242 |
| 3,655,046 | 4/1972 | Trussell | 210/152 |
| 3,685,653 | 8/1972 | Van Stavern et al. | 210/242 |
| 3,702,297 | 11/1972 | Maksim, Jr. | 210/242 |
| 3,767,571 | 10/1973 | Lorenc et al. | 210/40 |

*Primary Examiner*—Thomas G. Wyse
*Assistant Examiner*—Benoit Castel
*Attorney, Agent, or Firm*—James C. Wray

[57] ABSTRACT

A skimming separator for scavenging liquid and solid floating matter from the face of a body of liquid, wherein traction surfaced contiguous cylinders counter-rotate to frictionally convey a contacting layer of liquid and proximate flotage matter thereon directly into a natural floating reservoir formed by the cylinders and the body of liquid below. Within the reservoir, conveyed solid flotage is selectively either entrapped by a guard screen, or, by adjustment of the screen, abraded by the traction surface into a floating liquified slurry for disposal along with the conveyed originally liquid flotage by pump means. In passing through the nip of the contiguous cylinders, the traction surface is regenerated for reuse in the subsequent recirculation cycle. The traction surfaced material ranges from soft cellular materials to very hard abrasive coated materials as commonly used for industrial grinding purposes, and includes granular grit of discrete magnetic particle material which is movably retained by a magnetized base material, whereby the magnetic grit traction surface can be quickly adjusted by the addition or removal of material to meet immediate need during changing conditions in the scavenging operation. A compactor is included to compress and reduce the bulk of solid floating material such as metal, glass, and plastic foam materials, sea-weed, kelp, lilly pads, and the like.

23 Claims, 4 Drawing Figures

SEPARATORS

CROSS-REFERENCE TO RELATED APPLICATION

This application is a Continuation-In-Part of copending application Ser. No. 249,919; filed May 3, 1972, now abandoned.

BACKGROUND OF THE INVENTION

The present invention relates to separators for the skimming of liquids, as in gathering or collecting floating materials of various types from the face of a body of liquid into a confined area separated from the remaining face of the liquid.

Separators of various types are well known and widely used in a great number of industrial processes, and include several forms of separators for the skimming of liquids to recover various materials floating on the liquid. However, there are many factors which affect the successful utilization of skimming type separators for specific applications. For example, a separator for skimming oil, dross, or solid materials from a body of water in a controlled industrial process may function very well in that particular application, but be of little or no use in an unsheltered, open body of water with uncontrolled conditions of wind, waves, changing currents, unpredictable oil characteristics, floating trash, and debris of great variety. The need for scavenging oils and other forms of flotage from water for industrial processes, pollution control, and environmental protection purposes is particularly acute, and continues to be a growing problem with additional industrial activity, off-shore oil drilling, and marine transport operations. Through a myriad of sources, various types of oils and other materials frequently become a mixed flotage on open bodies of water. The oils form floating layer films or emulsions of various thickness which tends to spread into a thin layer distributed over a very large surface area, and it is often necessary to scavenge the oil from the face of the body of water as quickly as possible to avoid or minimize extensive pollution. The problem of scavenging unexpected oil spills is often compounded by delays and the oil becoming oxidized or emulsified, to the extent that it has very little film strength to adhere to oleophillic surfaces as frequently used for the selective separation of oil from water. In addition, the presence of other floating materials of a non-liquid or solid nature such as kelp, seaweed, tree leaves, pieces of wood, dead fish and water fowl, floating trash or rubbish, and the like, seriously interferes with the apparatus in attempts to skim the oil from the water, and it is common practice to remove the floating solids by tedious, time consuming methods prior to skimming the oil.

In the prior art and ancient methods of merely controlling the spread of oil on water, bulk materials have been used as flocculants, as weighting materials to sink the oil, oil thickening agents, and as floating absorbent sponge materials, such as straw, milled corn cobs, etc., which were added to and dispersed with the oil. However, if the oil was to be removed from the water, it was necessry to subsequently retrieve the widely scattered bulk material with the adhering or absorbed oil, generally after an extended period of time, great difficulty, and frequent mishaps. A major disadvantage in the use of such bulk materials is the large quantity of bulk material required and the attendant materials handling problems even when the bulk material is capable of being locally regenerated for reuse, which is not possible in many cases. Additionally, environmental protection requirements now often prohibit the use of materials of this type.

In other methods, not using bulk or loose materials as above, various forms of weir skimmers associated with pump means are frequently employed, but have the general disadvantage that increasing quantities of water are removed as the oil film thickness decreases, or as the water surface becomes turbulent due to waves or other disturbances. In addition, floating solid materials easily block the weir apertures, pump, and inlet line. Thus, for scavenging oil layers of lesser thickness, it is generally more advantageous to use rotary skimming separators which either absorbs or adsorbs the oil from the water on a selective basis, as by the use of regeneratable oleophilic conveying materials with which the oil easily adheres under favorable conditions. However, if the oil is in an oxidized or emulsified condition, as may easily occur if the oil is a very thin film or has been on the surface for an extended period of time, the use of oleophilic materials is much less effective and such separators become less selective. In addition, floating solid materials seriously interfere with apparatus of this type, as with the weir type skimmers. Typical rotary type skimming separator prior art for thin oil film scavenging is generally identified in the U.S. Patent Classification 210, as exemplified in the following specific references:

| U.S. Patent | Inventor |
|---|---|
| 1,573,085 | Meiani |
| 1,860,819 | Schamberger |
| 2,470,418 | Verner |
| 3,245,539 | Earle |
| 3,259,245 | Earle |
| 3,487,927 | Yahnke |
| 3,539,508 | Bulkley, et al |
| 3,546,112 | Will, et al |
| 3,576,257 | Yates |
| 3,578,585 | Yahnke |
| 3,587,860 | Ries, Jr. |
| 3,608,727 | Grutsch |
| 3,612,277 | Van Stavern, et al |
| 3,617,552 | Will & Grutsch |
| 3,617,555 | Ginsburgh & Will |
| 3,617,556 | Cole & Hess |
| 3,643,804 | Sharpton |

The above references typically comprise rotary or recirculating elements having regenatable oleophilic materials thereon to selectively convey adhering or absorbed oils from water. Other references of interest include those using magnetic particle materials, as exemplified by the following U.S. Pat. Nos.:

| | | | |
|---|---|---|---|
| 3,635,819 | Kaiser | 3,717,573 | Warren |
| 3,657,119 | Turbeville | 3,767,571 | Lorenc, et al |

In the above references, the magnetic particle material is generally used in a bulk form with oleophilic surfactants or absorbent sponge material, and initially used in an unmagnetized state distributed upon the oil. After a period of time, the magnetic particles are retrieved with a magnet means, with the oil adhering to the treated particles or being absorbed within a sponge material attached to and conveyed by the magnetic material under the influence of a magnetic field.

SUMMARY OF THE INVENTION

The object of the present invention is to provide a separator which overcomes the aforementioned problems and difficulties of the prior art in the skimming of floating materials from the face of a body of liquid, particularly in regard to the scavenging of oxidized or emulsified oils and floating solid materials from the face of a body of water.

In contrast with the prior art, the present invention comprises a pair of contiguous counter-rotating cylinders having a rough-textured frictional traction surface thereon, wherein the advancing traction surface area frictionally conveys a contacting layer of liquid and proximate materials floating thereon within the body of liquid directly into a collection reservoir, whereupon the conveyed flotage is retained until removed and the traction surface is regenerated for subsequent reuse during the next recirculation cycle.

The pair of contiguous cylinders are rotably mounted on a frame means maintaining the longitudinal axes of the cylinders in a common plane with the textured sides of the two cylinders pressed together as wringer rolls, and motor means is provided to rotate the cylinders in opposite directions.

At least one of the contiguous cylinders has a rough-textured traction surface thereon which can be of the cylinder body material or of a different material as a coating or covering on the side of the central cylinder body as a sheath or belt. The traction surface is sufficiently rough in texture as to provide an abrasive-like frictional grip with a contrasting layer of liquid, whereby advancing the textured surface within the body of liquid abrades and draws the contracting layer of liquid and proximate materials floating thereon along the advancing traction surface in passage within or through the body of liquid, thereby conveying the layer of liquid and floating materials into the collection reservoir.

Inasmuch as the traction surface does not lift the conveyed floating materials out of the body of liquid, there is no requirement for the traction surfaced material to be selective toward the liquid or materials to be conveyed, thus enabling the choice of a greater variety of traction materials which can be used for conveyance, and the skimming of a greater variety of flotage matter irregardless of the adhesive or cohesive properties thereof.

The conveying traction surface material can range from a very soft cellular elastomer such as a sponge rubber, to very hard materials commonly used as industrial abrasives such as granular metallic carbides and oxides, including tungsten carbide, silicon carbide, and aluminum oxide particles, attached to a base material as in conventional abrasive-coated materials. The primary attribute of the conveying traction material is a surface sufficiently rough with spaced projections of the material subject to being at least partially enveloped by a contacting liquid, whereby the rough surface and contacting liquid enmesh and advancing the traction surface frictionally entrains the contacting liquid, thereby frictionally conveying the contacting layer of liquid with advancement of the traction surface. The traction surface texture should not be smooth or slick. Textures similar to that of non-skid walk-ways and road surfaces, textured wall surfaces of buildings, sandstone, and abrasive coated materials such as sandpaper and grinding discs typify characteristic rough surfaces suitable for the conveying surface. Other suitable texture surface examples include that of cellular materials wherein the edges of the cellule walls form the abrasive surface, apertured web materials such as screen, net or matting, and perforated sheet materials. For best results, particularly in the skimming of a thin liquid film, the traction surface material should not be absorbent as a sponge with open cell structure unless the thickness of the absorbent sponge can be adjusted or controlled as needed for the thickness of the film to be skimmed. The use of absorbent sponge materials is objectionable for several reasons, but especially because of extremely critical speed control requirements as the film decreases in thickness. For example, in skimming a layer of oil from the face of a body of water, a diminishing oil film thickness results in the sponge material absorbing greater quantities of water unless the rotational or conveying speed is reduced to the precise point, or less, where the thin oil film saturates the sponge. Consequently, for very thin oil films, the rotational speed must be very slow and closely controlled, but in this situation, wave motion of the water tends to wash out the absorbed oil. However, if the absorbent sponge thickness is reduced or controlled, commensurate with the oil film thickness, the conveying speed control is much less critical; the efficiency of the skimming process can be more easily maintained, and the oil film can be skimmed more quickly.

In the present invention, the textured traction surface can be formed by a magnetized base material which magnetically retains a quantity of discrete magnetic particles to the base material as a blanket of movable grit, thereby forming a highly abrasive, tooth traction surface on the magnetized base material; and by adding or removing granular magnetic particles, the thickness of the magnetic particle blanket can be readily adjusted commensurate with the oil film thickness.

Another objection to conventional absorbent sponge material is that small particles of non-liquid flotage tends to plug or clog the cell openings, which soon leads to excess strain and breakdown of the sponge structure. Consequently, a carefully selected guard screen is usually required, which restricts the flow of oil to the absorbent sponge. However, by the use of magnetic particle materials as in the present invention, the small non-liquid flotage particles are quickly masticated by the movable magnetic particles retained by the magnetic field of the magnetized base material, and the resultant pulp is easily dislodged as a slurry. Therefore, the guard screen, if used, can have larger openings, with less restriction to the oil flow.

The magnetized base material can be a plurality of magnets imbedded within a spacing matrix, including magnets comprising ferrite particles imbedded in plastic materials, as commercially available in thin, flexible sheet and strip forms either with or without a bonded metal backing plate to enhance the magnetic field strength and provide mechanical strength.

The magnetic particle material can be a composition of iron, such as magnetite or typical iron powders as commonly used in many industrial applications such as powder metallurgy and welding processes, and includes magnetically responsive iron ores and mill scales. For best results, the magnetic particles are larger than 0.045 mm, or 45 micrometer, as determined by the U.S.A. Standard Sieve Series Designation adopted in 1970 by the American Society of Testing Materials and National Bureau of Standards, and recommended by the International Standards Organization, Geneva, Switzerland, and also identified as the Tyler Standard Screen Scale Sieve Series No. 325.

When the floatage to be skimmed contains solid materials of appreciable size or quantity, it is preferred that the conveying traction surface comprise very hard abrasive particles such as silicon carbide and the like as commonly used with industrial abrasive materials, and that a guard screen be used to prevent entry of excessively large amounts of the flotage between the pair of cylinders. If desired, the guard screen can also be used to fix the location or position of the conveyed flotage into sustained contact with the advancing abrasive particles of the traction surface, for abrading or grinding of the flotage into particles of smaller size and subsequent passage as a floating slurry into the collection reservoir.

In order to more fully describe the present invention, reference is made to the description of the preferred embodiment and the figures of the accompanying drawing.

DESCRIPTION OF THE PREFERRED EMBODIMENT

Figure 1:
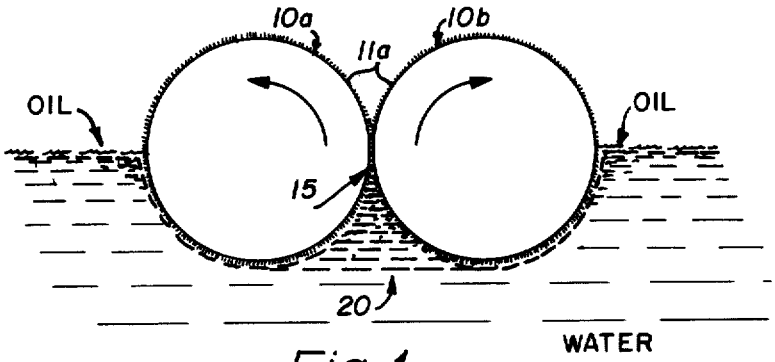
FIG. 1 represents a side view of closed ends of a contiguous pair of counter-rotating cylinders (10*a* & 10*b* having a rough-textured traction surface 11*a* thereon, with the cylinders in a horizontal position and partially immersed in a flotage of oil on the face of a body of water.

Referring to FIG. 1, a pair of cylinders 10*a* & 10*b* having a rough-textured traction surface 11*a* thereon are rotably mounted within a conventional frame means 1 and rotated in opposite directions by a conventional motor means 2. The frame means maintains the axes of the cylinders 10 in a common plane and the sides of the cylinders 10 mutually contiguous by being pressed against each other to form a closed nip 15, as in a pair of wringer rolls. The cylinders 10 can be modified forms of a generally cylindrical shape, such as a linearly tapered cylinder or cone, or a non-linear form such as a spool, barrel, or crowned pulley. The rough-textured traction surface 11*a* is sufficiently rough or abrasive in character as to frictionally engage and convey a contacting liquid and floating matter thereon during advancement of the traction surface 11*a* with rotation of the cylinders 10, and can be formed either directly on the material of the cylinders 10 or upon a different material covering at least one of the cylinders 10 as a sheath or belt, or retained on the cylinders 10 by conventional attachment means such as a clamp, adhesive, or magnetic retainer. For best results, the textured traction surface 11*a* on at least one of the cylinders 10 can include a resilient or compliant material such as an elastomer in either a cellular or a solid form.

In skimming of flotage from a body of liquid, at least one of the cylinders 10 having the textured traction surface 11*a* thereon is partially immersed in the body of liquid, such as the water indicated, to engage and frictionally convey the contacting upper layer of water upon which the flotage to be skimmed is floating, such as the oil as shown. As the cylinders 10 rotate, the traction surface 11*a* conveys the contacting layer of water, which, by internal fluid friction, entrains the proximate flotage for conveyance along with the contacting layer of water, whereby the flotage becomes enmeshed with the textured traction surface 11*a* and conveyed within or through the body of water to the closing nip 15 formed by the advancing traction surfaces 11*a* of the pair of cylinders 10 converging together. As the conveyed flotage approaches the nip 15, the press of the contiguous cylinders 10 squeezes a major portion of the conveyed flotage off the traction surface 11*a*, thereby regenerating the traction surface 11*a* and retaining the squeezed flotage within a collection reservoir 20 which is formed and confined in part by the sides of each of the partially immersed cylinders 10 and in part by the upper surface of the lower body of water which buoys up the flotage. As the regenerated traction surface 11*a* recirculates with rotation of the cylinders 10 and conveys additional flotage into the reservoir 20, the previously accumulated flotage acts to strip excess water from the flotage being conveyed prior to squeezing and retention within the collection reservoir 20. If desired, the accumulation of collected oil flotage can be removed from the reservoir 20 by conventional pump means (not shown) having the inlet line opening below the upper liquid level within the reservoir 20. Although not essential, the collection reservoir 20 capacity can be increased by attaching side walls (not shown) to the frame means, whereby the side walls extend across the ends of the cylinders 10 and further confine the reservoir 20. With the cylinders 10 in a substantially horizontal position as shown, the water flow or direction of travel of the cylinder pair 10 can be in either a longitudinal or lateral direction, as desired to engage and skim additional flotage from the face of the body of water. It is not essential that the cylinders 10 be sustained in a horizontal position, and in some applications it can be advantageous to have the cylinders 10 inclined in an angular position relative to the liquid to be skimmed. In such applications, the collected flotage is buoyed upward toward the higher end of the cylinder pair 10 with easier access for observation and removal by the pump means.

Figure 2:
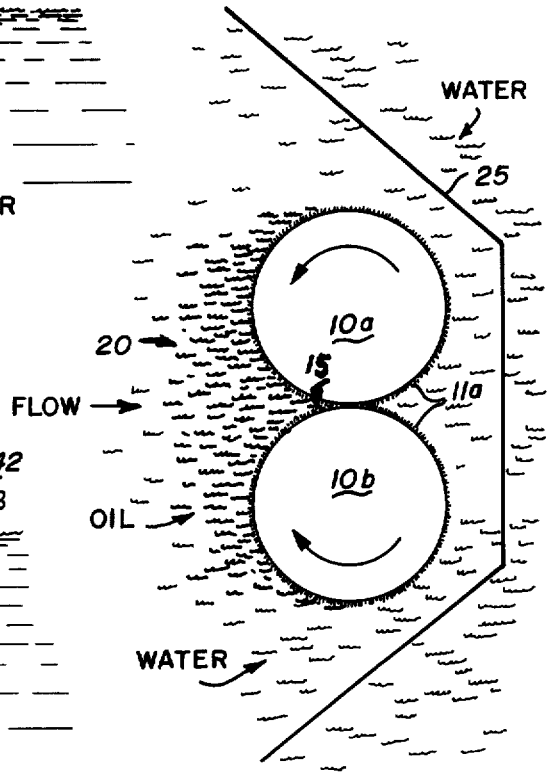
FIG. 2 represents a top view of closed ends of a contiguous pair of counter-rotating cylinders 10*a* & 10*b* having a rough-textured traction surface 11*a* thereon, with the cylinders in a vertical position and partially immersed in a flotage of oil on the face of a body of water, and the upper edge of a partitioning guide chute 25 extending downward into the water.

Referring now to FIG. 2, the contiguous cylinders 10*a* & 10*b* with the textured traction surface 11*a* thereon are rotably mounted in a vertical position within a frame means (not shown) and rotated in opposite directions by conventional motor means (not shown). A partitioning guide chute 25 can also be attached to the frame means to funnel or direct flotage into the proximity of the cylinders 10. With the flotage flow as shown, or the direction of travel of the cylinder pair 10 in the opposite direction, the cylinders should rotate in the directions shown for best results if the chute 25 is not used. If the chute 25 is used, the cylinders 10 can be rotated either in the directions shown or in the opposite directions in which case the reservoir 20 forms on the opposite side from that shown, thereby providing a more sheltered and more closely confined reservoir 20.

Figure 3:
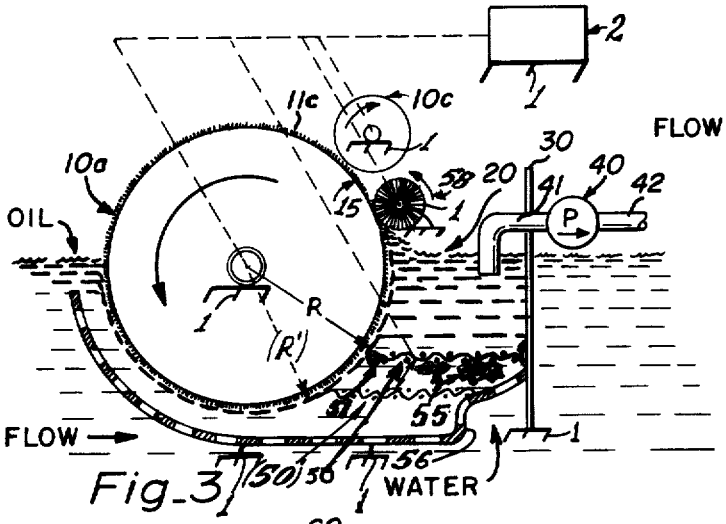
FIG. 3 represents a side view of closed ends of a contiguous pair of counter-rotating cylinders 10*a* & 10*c* with one of the cylinders 10*a* having a rough-textured traction surface 11*c* thereon, with the cylinders in a horizontal position and partially immersed in a flotage of oil and floating solid matter 55, a guard screen 50, a portion of a reservoir wall 30, and pump means 40 having an inlet line 41 entrance opening below the upper surface of the liquid level.

Referring now to FIG. 3, the contiguous cylinders 10*a* & 10*c* are rotably mounted in a horizontal position in a frame means (not shown) including a reservoir rear wall 30 and reservoir side walls (not shown), with the cylinders 10 rotated by conventional motor means (not shown). One of the cylinders 10*a* has a textured traction surface 11*c* thereon sufficiently rough to frictionally engage and convey either liquid or solid floating materials from the face of the water into a collection reservoir 20 divided by a guard screen 50 spaced clear of the traction surface 11*c*. The guard screen 50 can be pivotally mounted around the cylinder 10*a* axis, and secured in selected positions within the reservoir 20 by latch means (not shown). If the traction surface 11*c* is a firm or hard surface, cylinder 10*c* should have a resilient surface which can be either smooth or with a textured surface. In skimming operation, cylinder 10*a* is partially immersed in the body of liquid to be skimmed, and cylinder 10*c* can also be immersed if desired. The traction surface 11*c* can range from soft elastomers to the hardest of industrial abrasives, depending upon the nature of the flotage materials to be skimmed and what is to be done with the collected material. If the flotage is a relatively clean and fresh oil of appreciable thickness with limited amounts of solid materials present, a cellular elastomer traction surface 11*c* can be used wherein the edges of the cellule walls act as abrasive teeth to engage the oil, and the concave cellule cavities act as chambers to carry the oil during conveyance. However, it is preferable that the material be of closed cell structure, rather than open cell structure as in an absorbent sponge. Alternatively, the traction surface 11*c* can be comprised of a magnetized base material attached to the cylinder 10*a* with a granular grit of magnetic particle material movably attached to the magnetized base material by the magnetic field thereof. During skimming operations, the magnetic particle traction surface 11*c* can be adjusted by the addition or removal of granular magnetic particles for the best results commensurate with the thickness of the oil film to be skimmed. If the flotage contains appreciable quantities of solid materials, a more firm and harder traction surface 11*c* can be used with better results. If the liquid and solid flotage materials are to be segregated, as would be desired if the liquid has salvage value, the guard screen 50 would be adjusted to retain the solid flotage 55 spaced away from the traction surface 11*c*. On the other hand, if it is desired to dispose of the solid flotage along with the liquid flotage, the guard screen 50 can be adjusted with the edge 51 nearest the traction surface 11*c* tilted upward, whereby the solid flotage 55 is buoyed upward by the water against the traction surface 11*c* and abraded or ground into pulp and combined with the liquid flotage to form a slurry floating upward through the guard screen 50 into the upper portion of the collection reservoir 20 for removal by a pump means 40. In skimming operations of this nature, it is better for the traction surface 11*c* to be a very hard industrial abrasive, such as silicon carbide or the like, to provide maximum endurance. It is to be noted that some forms of solid flotage, such as metal or glass containers, float only by virtue of entrapped air, and if ground or abraded sufficiently by the traction surface 11*c*, will lose the entrapped air and then sink rather than float. To retain such articles, a container or means 56 can be included below the cylinder 10*a* for subsequent removal by conventional means.

In abrading some types of non-liquid or semi-solid materials of a fibrous nature, the abraded fibrous matter may tend to become entangled or embedded with the granular abrasive particles of the traction surface 11*c*. If desired, a carding brush 58 can be mounted on the frame means and in contact with the traction surface 11*c* as to brush and remove the entangled fibrous matter from the traction surface 11*c*, preferably within the reservoir 20, to prevent the fibrous material entering the nip 15 between the pair of cylinders 10.

Figure 4:
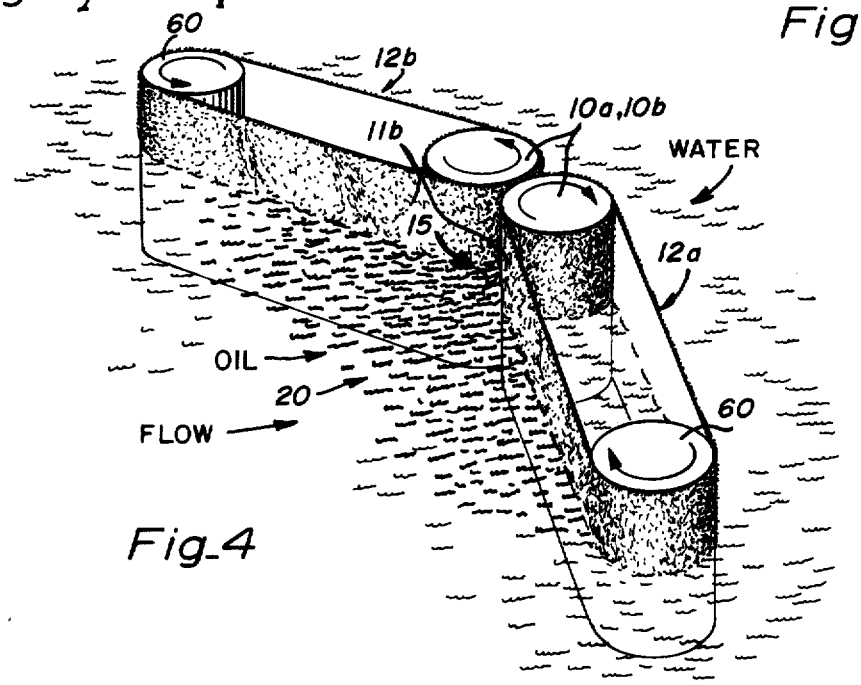
FIG. 4 represents a perspective view of closed ends of a contiguous pair of counter-rotating cylinders 10*a* & 10*b* having a rough-textured traction surface 11*a* thereon extended by an endless belt web 12*a* & 12*b* having a rough-textured traction surface 11*b* thereon recirculating around the cylinders 10*a* & 10*b* and belt tensioning rolls 60, with the cylinders, rolls, and belts in a vertical position and partially immersed in a flotage of oil on the face of a body of water.

Referring now to FIG. 4, the contiguous cylinders 10*a* & 10*b* having a rough-textured traction surface 11*a* thereon can be rotably mounted in a vertical position within a frame means (not shown) and rotated in opposite directions by a conventional motor means (not shown). In addition, an endless belt web 12 having a textured traction surface 11*b* thereon covers at least one of the contiguous cylinders 10 and is recirculated with rotation of the cylinders 10 as to provide an extended traction surface 11*b* supplementing the tractive surface 11*a* of the cylinder 10. An idler roll 60 can be rotably mounted within the frame means and within a loop of the belt web 12, to provide tension on the belt web 12 sufficient to maintain the belt web 12 as a recirculating curtain spanned between the contiguous cylinders 10 and the idler roll 60. The belt web 12 can be a screen, net or perforated material, either with open mesh or apertures, or with an impervious membrane bonded with the material as to effectively block the apertures. For example, the belt web 12 can be a metal or plastic screen, coated with an elastomer. Alternatively, the belt web 12 can be a more resilient material, such as a cellular elastomer, or a more abrasive material such as conventional abrasive coated fabrics as commonly used in industrial sanding and grinding belts. In skimming operation, the belt web 12 is partially immersed in the body of liquid, whereby the recirculating traction surface 11*b* advances within the body of liquid and frictionally conveys the contacting layer of liquid and proximate materials floating thereon into a collection reservoir 20 floating upon the body of water and confined by the belt web 12. The nip 15 of the contiguous cylinders 10 prevents passage of the collected floating materials between the cylinders 10, thereby regenerating the textured traction surface 11*b* for reuse in the subsequent recirculation cycle. Pump means (not shown) can be used to remove the collected floating material from the collection reservoir 20.

In the scavenging of substantially large quantities of solid and semi-solid flotage such as metal, glass, and plastic articles, as mentioned in describing FIG. 3; and other forms of non-liquid flotage such as plastic foam materials, sea-weed, kelp, water-lilies, straw, and the like, it is often desirable to compress and reduce the bulk of the scavenged flotage and retain it as a compacted solid instead of abrading it into a slurry for disposal with the liquid. In such case, a compactor (not shown) can be mounted on the frame means and operated by the motor means to compress the flotage. The compactor can be a conventional ram type with linear travel, or a hinged jaw type as commonly used with conventional rock crushers. The guard screen 50 can be used as a part of the compactor, as the ram head or one of the jaws which can be either stationary or actuated by the motor means. Otherwise, a separate compacting element can be located between the guard screen 50 and a container to receive the compacted flotage, as the container described in FIG. 3, to retain abraded and sunken articles. The container (not shown) can be independently attached to the frame means, or the container can be a removable, integral part of the compactor whereby the flotage is compressed within the container.

The invention described and claimed is:

1. A skimming separator for scavenging floating matter from the face of a body of liquid by frictional tractive conveyance, which comprises in cooperative combination:

a supporting structural frame means;

motor means;

a pair of contiguous cylinders 10 rotatably mounted on the frame means and rotated in opposite directions by the motor means, with the side of at least one of the pair of rotating cylinders 10 having a rough textured frictional traction surface material 11 thereon which traction surface material comprises a surface of discrete abrasive elements which is advanced in recirculation with rotation of the cylinders 10 and subjected to a compressive force in passing through a nip 15 formed between the pair of contiguous counter-rotating cylinders 10, the cylinders being mounted for moving the rough frictional traction surface through the proximate floating matter and through an upper layer of liquid and continuing moving through the liquid toward the nip, whereby partial immersion of the advancing traction surface 11 in a body of liquid frictionally engages a contacting layer of the liquid and tractively conveys the upper layer of the liquid and proximate matter floating thereon within the body of liquid directly into a collection reservoir 20 which is formed and confined in part by the advancing traction surface 11 and in part by the body of liquid, wherein the conveyed layer of liquid and floating matter is substantially retained by being at least partially prevented from further tractional conveyance by being compressed and squeezed off the traction surface 11 in passage through the nip 15 between the pair of contiguous cylinders 10, whereupon the traction surface 11 thereby becomes sufficiently regenerated for tractively conveying additional quantities of the upper layer of the liquid and proximate matter floating thereon during the subsequent recirculation of the traction surface 11 with rotation of the cylinders 10, thereby continually skimming floating matter from the face of the liquid by frictional tractive conveyance and separating the scavenged floating matter skimmed from the upper layer of the liquid by confinement within the collection reservoir; and a guard screen at least partially immersed in the liquid and in a spaced clearance position relative to the advancing traction surface with means connecting the guard screen with the frame means, whereby excessive quantities of solid matter are prevented from entering between the cylinders.

2. Claim 1., wherein the guard screen 50 and buoyancy of the body of liquid positions floating solid matter into contact with the advancing traction surface 11, whereby the floating solid matter is abraded into particles of smaller size and passed into the collection reservoir 20 with liquids as a floating slurry.

3. Claim 1., further including a carding brush mounted on the frame means and in contact with the advancing traction surface 11, whereby the solid matter is brushed from the traction surface 11.

4. Claim 1, wherein the rough textured frictional traction surface 11 comprises a non-absorbent cellular material, whereby the edges of cell walls form an abrasive traction surface 11.

5. Claim 1., wherein the traction surface 11 comprises a magnetized base abd a granular grit of discrete magnetic particles responsive to a magnetic field of the magnetized base, whereby the magnetic particles are movably retained by the magnetized base to form the traction surface 11 thereon, and whereby the thickness of the traction surface 11 is controlled by the addition and removal of magnetic particles.

6. Claim 1., wherein the traction surface 11 includes abrasive particles attached to a base material.

7. Claim 1., wherein the traction surface 11 comprises a resilient material.

8. Claim 1., further including an idler roll 60 rotably mounted on the frame means, and an endless belt web 12 having a traction surface 11 thereon, with the belt web 12 being looped around the idler roll 60 and one of the pair of rotating cylinders 10 and recirculated with rotation of the cylinders 10, whereby the belt web 12 traction surface 11 equivalently extends the traction surface 11 of the cylinders 10, thereby frictionally conveying flotage matter into the collection reservoir 20.

9. Claim 1., further including side walls attached to the frame means extending across the ends of the cylinders 10 and into the body of liquid, whereby the capacity of the reservoir 20 is increased.

10. Claim 9., further including a rear wall 30 attached to the frame means and side walls, whereby the reservoir 20 is in part confined by the rear wall 30.

11. Claim 1., further including a guide chute 25 attached to the frame means and extending into the body of liquid, whereby the flow of flotage matter is directed into the proximity of the pair of cylinders 10 and traction surface 11 thereon, and whereby the counter rotating cylinders 10 are operable in two directions of rotation.

12. Claim 1., further including pump means 40 having an outlet line and an inlet line 41 attached to the frame means with the inlet line 41 entrance opening located below the liquid level within the collection reservoir 20, whereby accumulated liquid and slurry flotage matter within the reservoir 20 is removed from the reservoir 20 by the pump means 40.

13. Claim 1., further including a container attached to the frame means and located below the pair of rotating cylinders 10, whereby initially floating articles abraded and sunken by the traction surface 11 are retained.

14. Claim 13., further including a compactor mounted on the frame means and operated by the motor means in cooperative association with the container, whereby scavenged bulky flotage is compressed to reduce the bulk and forced into the container.

15. The skimming separator of claim 1 wherein the continuous cylinders in the pair each have rough textured frictional traction surface.

16. The skimming apparatus of claim 15 wherein the continuous cylinders are of equal size.

17. Skimming separator apparatus comprising counter-rotating cylinders partially immersed in a liquid and positioned adjacent each other for linear contact, rough textured frictional traction surface material means separately connected to each of the cylinders for engaging floating matter and being mounted for mutually engaging near the linear contact to remove liquid from the surface material means, which traction surface material comprises a granular grit of discrete particles and collection means positioned near the linear contact for collecting removed liquid, and a guard screen at least partially immersed in the liquid and in a spaced clearance position relative to the advancing traction surface with means connecting the guard screen with the frame means, whereby excessive quantities of solid matter are prevented from entering between the cylinders.

18. The skimming separator means of claim 17 wherein the surface means comprises cellular materials.

19. The skimming separator means of claim 18 wherein the surface means comprises abrasive grit.

20. The skimming separator comprising a rotating cylinder partially submerged in a liquid, a rough textured frictional surface material means connected to the cylinder for engaging floating matter, the surface material means including a surface material comprising granular grit of discrete particulate material, means contacting the surface means for removing liquid from the surface means, and a guard screen at least partially immersed in the liquid and in a spaced clearance position relative to the advancing traction surface with means connecting the guard screen with the frame means, whereby excessive quantities of solid matter are prevented from entering between the cylinders.

21. The skimming separator comprising a rotating cylinder partially submerged in a liquid body, surface means connected to the cylinder for engaging floating material on the liquid body, the surface means comprising a granular grit of discrete particles, removing means contacting the surface means for removing material from the surface means, collection means near the removing means for collecting material removed from the surface means by the removing means, screen means mounted slightly spaced from the cylinder near the collection means and mounted near a part of the collection means remote from the removing means, the screen means comprising a guard screen at least partially immersed in the liquid and in a spaced clearance position relative to the advancing traction surface with means connecting the guard screen with the frame means, whereby excessive quantities of solid matter are prevented from entering between the cylinders and means for rotating the cylinder in a direction to drag floating materials engaged by the surface means through the liquid body by the screen means and successively by the removing means whereby solid material in the floating material is trapped by the screen means.

22. The skimming separator of claim 21 wherein screen means is submerged in the liquid body and wherein the screen means has a slope toward the cylinder and in a direction of rotation of the cylinder, whereby the screen means urges solid material toward the surface means and whereby engagement of solid material mutually by the screen means and surface means abrades the solid material and reduces sizes of solid particles.

23. The skimming separator of claim 22 further comprising a container positioned beneath the cylinder for catching sinking solid material falling from the screen means and surface means.

* * * * *